US007380512B2

(12) United States Patent
Curtin

(10) Patent No.: US 7,380,512 B2
(45) Date of Patent: Jun. 3, 2008

(54) STORAGE SPACE FOR WATERCRAFT

(75) Inventor: Michael Augustin Curtin, Newnan, GA (US)

(73) Assignee: Yamaha Motor Manufacturing Corporation of America, Newnan, GA (US)

( * ) Notice: Subject to any disclaimer, the term of this patent is extended or adjusted under 35 U.S.C. 154(b) by 140 days.

(21) Appl. No.: 10/970,153

(22) Filed: Oct. 21, 2004

(65) Prior Publication Data

US 2006/0086297 A1 Apr. 27, 2006

(51) Int. Cl.
*B63B 35/73* (2006.01)

(52) U.S. Cl. ..... 114/55.53

(58) Field of Classification Search ..... 114/55.5, 114/55.51, 55.53

See application file for complete search history.

(56) References Cited

U.S. PATENT DOCUMENTS

| | | | | |
|---|---|---|---|---|
| 3,491,909 | A * | 1/1970 | Ikelheimer | 217/7 |
| 5,538,148 | A * | 7/1996 | Indyk | 211/195 |
| 6,145,458 | A | 11/2000 | Hattori | |
| 6,553,928 | B2 * | 4/2003 | Yamada et al. | 114/55.51 |
| 6,668,742 | B2 * | 12/2003 | Nadeau et al. | 114/55.5 |

* cited by examiner

*Primary Examiner*—Jesús D Sotelo
(74) *Attorney, Agent, or Firm*—Keating & Bennett, LLP

(57) ABSTRACT

A watercraft includes a lower hull, a deck having an opening provided therein, a storage plate, and a storage space defined by a portion of the lower hull, a portion of the deck, and the storage plate. The storage plate has at least one folding line such that the storage plate can be inserted through the opening in the deck when the storage plate is folded along the at least one folding line, and such that the storage plate can be unfolded and installed inside of the hull to define the storage space.

20 Claims, 5 Drawing Sheets

STORAGE SPACE FOR WATERCRAFT

BACKGROUND OF THE INVENTION

1. Field of the Invention

The present invention relates to a storage space for watercraft. More specifically, the present invention relates to a storage space in a watercraft defined by a surface of the hull of the watercraft and a storage plate.

2. Description of the Related Art

As shown in FIG. 6, a conventional watercraft 100 includes a known storage space which is defined by the combination of a hatch cover 170 provided in front of a steering mast 130 that extends above the bow portion of the deck 160 and a removable storage box 320. The hatch cover 170 is able to open and close freely, thereby exposing the forward section of the interior of the hull 120. The hatch cover 170 defines a generally smooth outer surface and is shaped to cooperate with the remainder of the deck 160 so that the bow of the watercraft has an aerodynamic design. A latch 280 is provided to secure the hatch cover 170 in its closed position during the operation of the watercraft 100. The hatch cover 170 is attached to the deck 160 by a hinge 300. The storage box 320 is removably provided in the deck 160 below the hatch cover 170. This storage box 320 is covered by the hatch cover 170 in a watertight manner.

However, the prior art storage box 320 suffers from several problems. Only a portion of the space defined by an area between the lower hull 140 and the deck 160 of the hull 120 is available for storage space. The size of storage box 320 is limited by the size of the opening 150. Thus, the storage space is unnecessarily small in size.

In addition, the storage box 320 must be completely removed from and later re-installed in the watercraft 100 in order to allow access to other components, such as a fuel tank capacity sensor, a pump module, a fuel tank or other components, that are located inside of the hull 120 of the watercraft 100 in an area that is rearward of the storage box 150 and below the steering mast 130.

SUMMARY OF THE INVENTION

To overcome the problems described above, preferred embodiments of the present invention provide a watercraft having a large storage space that is simple to manufacture and easy to assemble and disassemble, and that allows for easy access to components located inside of a hull of the watercraft.

According to a preferred embodiment of the present invention, a watercraft includes a lower hull, a deck having an opening provided therein, a storage plate, and a storage space defined by a portion of the lower hull, a portion of the deck, and the storage plate, wherein the storage plate has at least one folding line such that the storage plate can be inserted through the opening in the deck when the storage plate is folded along the at least one folding line.

The lower hull preferably includes at least one liner extending upwardly toward the deck, and the storage space is defined by the at least one liner, the portion of the deck and the storage plate.

Alternatively, the lower hull includes a plurality of liners that extend upward from the lower hull toward the deck, and the storage plate is attached to a plurality of locations along the plurality of liners.

The storage plate is preferably larger than the opening in the deck when the storage plate is in an unfolded state and is smaller than the opening in the deck when the storage plate is in a folded state.

The storage plate is removably attached to at least one of the lower hull and the deck such that the storage plate has at least one fold defining at least two sections arranged at an angle relative to each other. The storage plate preferably includes at least one mounting member, such as a flange, for attaching the storage plate to at least one of the lower hull and the deck. The storage plate also preferably includes at least one fastening member, such as a plastic rivet, for attaching the storage plate to at least one of the lower hull and the deck.

The storage space is preferably located in a bow of the watercraft and preferably includes a floor disposed at a top portion of the lower hull and at a bottom portion of the storage space, and the storage plate is preferably attached to the floor of the storage space. The storage space is preferably further defined by a hatch cover that covers the opening in the deck.

According to another preferred embodiment of the present invention, a method of manufacturing a watercraft includes the steps of providing a watercraft having a lower hull and a deck, the deck having an opening therein, inserting a storage plate into the opening of the deck, and forming a storage space defined by a portion of the lower hull, a portion of the deck, and the storage plate.

The step of forming a storage space preferably includes removably attaching the storage plate to at least one of the lower hull and the deck.

The method also preferably includes the steps of contracting the storage plate before the step of inserting and expanding the storage plate during the step of forming the storage space, wherein the step of contracting the storage plate is performed by folding the storage plate along bend lines formed therein, and the step of expanding the storage plate is performed by unfolding the storage plate along the bend lines.

The lower hull preferably includes liners that extend upward from the lower hull toward the deck, and the storage space is defined by the liners, the portion of the deck, and the storage plate.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENT

FIGS. 1-5 illustrate preferred embodiments of the present invention in the form of a watercraft 10.

Figure 1:
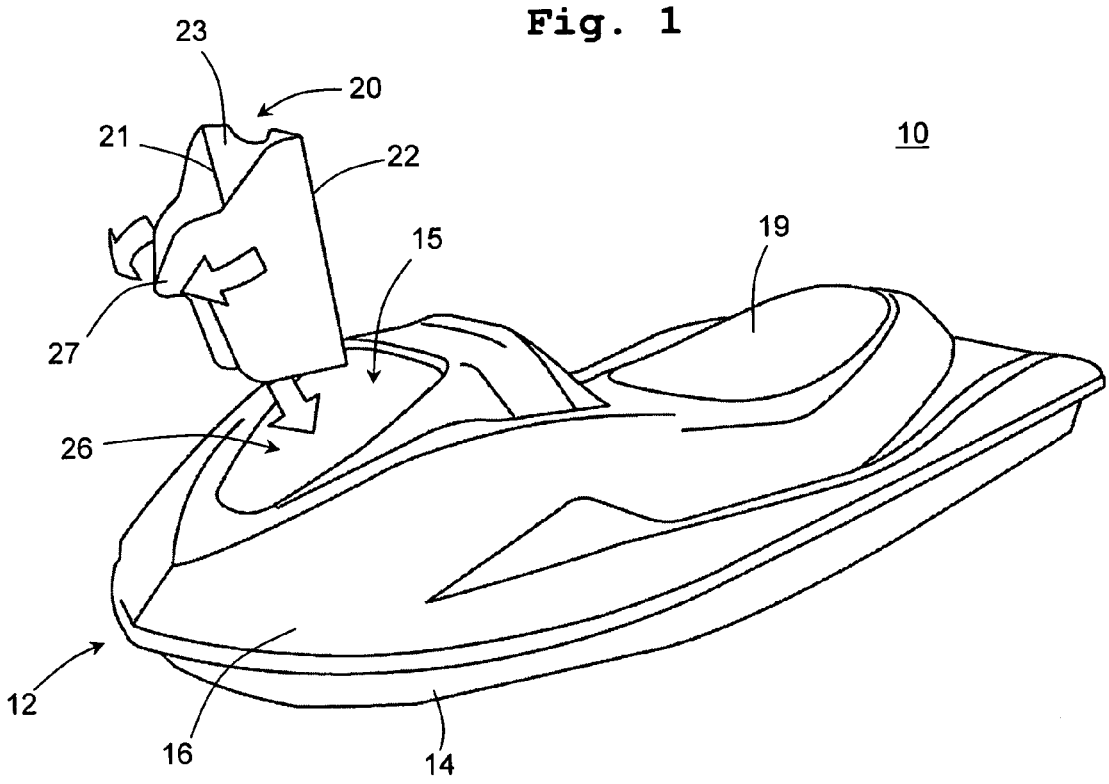
FIG. 1 is an illustration of the insertion of a folded storage plate into the hull of a watercraft according to a preferred embodiment of the present invention.

As seen in FIG. 1, in the watercraft 10 according to a preferred embodiment of the present invention, a storage space 26 and a storage plate 20 are provided. The storage plate 20 is preferably made of plastic, but can be made of other materials as appropriate. The storage space 26 is located within the hull 12 of the watercraft 10, between the deck 16, the storage plate 20 and the lower hull 14 of the hull 12, as will be described in more detail below. Preferably, the storage space 26 is located in front of the seat area 19 in the bow of the watercraft 10.

A personal watercraft 10 is shown in FIG. 1. It should be noted that the storage space 26 defined by a portion of the deck 16, the storage plate 20 and a portion of the lower hull 14 of the hull 12 can be applied to any type of watercraft such as a motorboat, sailboat, kayak, canoe, etc.

Figure 3A:
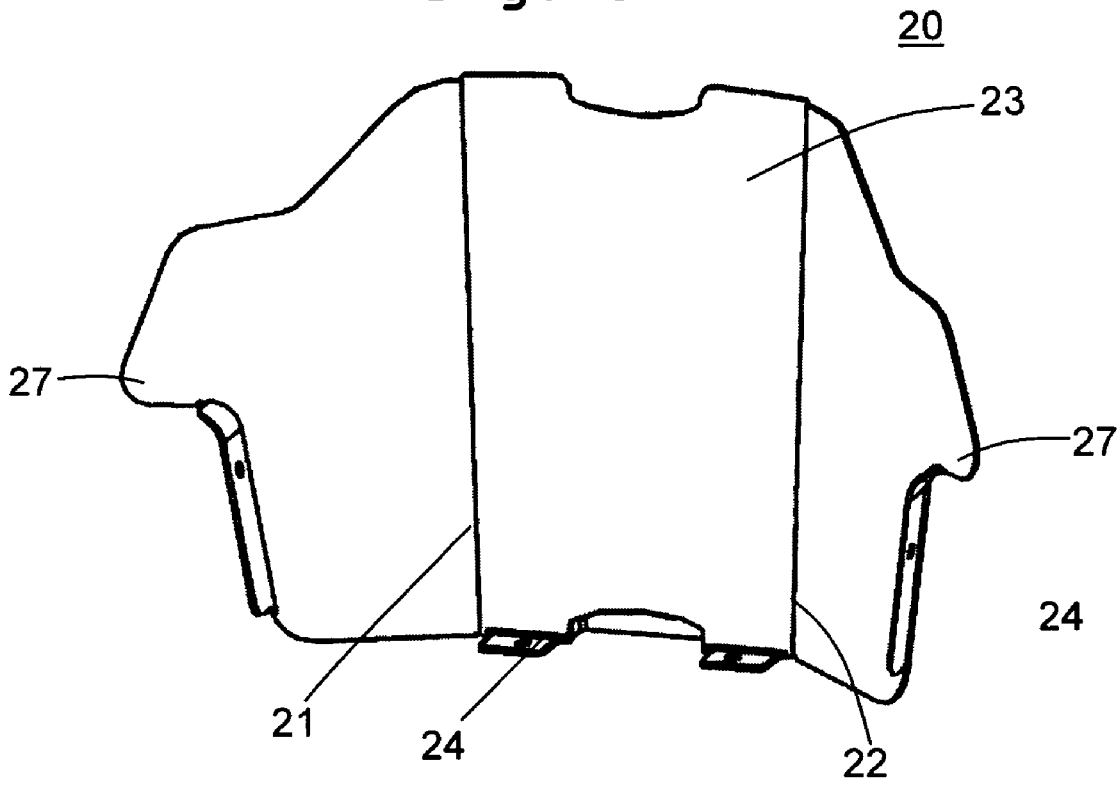
FIG. 3A is front view of the storage plate according to a preferred embodiment of the present invention.
Figure 3B:
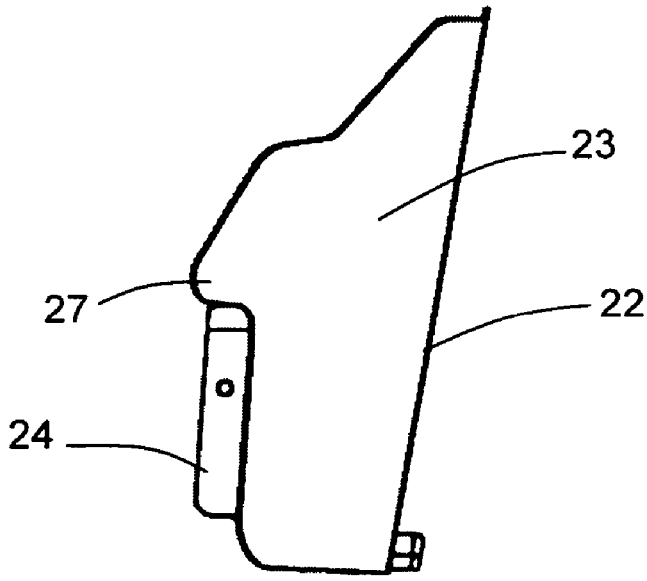
FIG. 3B is a side view of the storage plate according to a preferred embodiment of the present invention.

As shown in FIGS. 3A and 3B, the storage plate 20 preferably includes a storage plate body 23 having at least one bend line, but in this preferred embodiment, the storage plate 20 preferably has at least two bend lines including a first bend line 21 and a second bend line 22. As can be readily understood from FIG. 3A, the bend lines 21 and 22 divide the storage plate body 23 into a plurality of sections, i.e., three sections in FIG. 3A. The number, arrangement and orientation of the bend lines can be changed as desired. Thus, the number of sections of the storage plate body 23 can be varied as desired, as long as the storage plate 20 can be contracted in size by folding or some other method so as to be fitted into the opening 15, and then once inside the hull 12, the storage plate body 23 can be expanded so as to define a wall of the storage space 26 as will be described in more detail below.

The storage plate 20 also preferably includes mounting members 24 which are preferably in the form of flanges 24. The flanges 24 are preferably positioned at the edges of one or more sections of the storage plate body 23 to enable reliable securing of the storage plate body 23 to the interior of the hull 12. The flanges 24 are preferably constructed to receive a mating fastening member 25, shown in FIG. 2A, such as a rivet, clip, locking member, etc., which is preferably made of plastic. The mounting members 24 are not limited to the flanges shown in FIGS. 3A and 3B and can be changed as desired.

Now a description of how the storage plate 20 is inserted into and mounted to the watercraft 10 will be provided. As shown in FIG. 1, a watercraft having a hull 12 with an opening 15 in the deck 16 is first provided. Then, the storage plate 20 is folded along the first bend line 21 and the second bend line 22 such that ends 27 of the storage plate body 23 are arranged near each other. Then, the folded storage plate 20 is inserted into the interior of the hull 12 through the opening 15 in the deck 16.

Figure 2A:
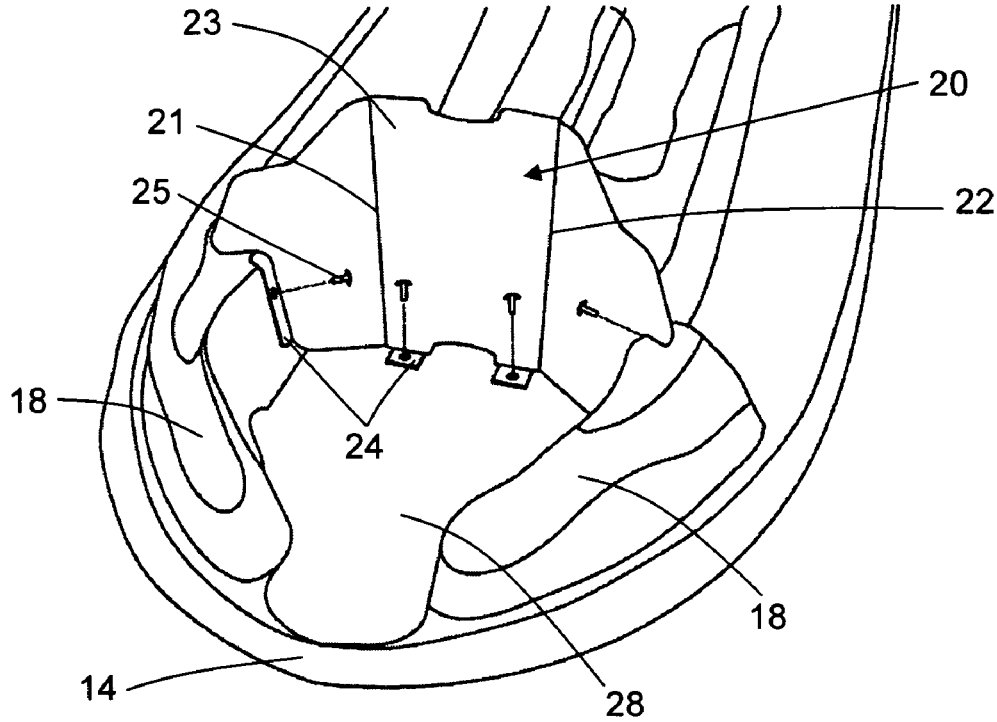
FIG. 2A is an illustration of the storage plate and the lower hull according to a preferred embodiment of a present invention.

Once the storage plate 20 is inserted into the opening 15, the storage plate 20 is unfolded. As shown in FIG. 2A, the storage plate 20 is attached to the lower hull 14 of the watercraft 10. FIG. 2A shows the watercraft without the deck 16 for the convenience of illustrating how the storage plate body 23 is attached to the lower hull 14 of the watercraft. As shown in FIGS. 2A, 3A, and 3B, the mounting members 24 of the storage plate body 23 are preferably disposed on the bottom and the sides of storage plate body 23.

Each of the mounting members 24 of the storage plate body 23 are preferably attached to the lower hull 14. However, additional mounting members 24 could be used to attach the storage plate 20 to the deck 16. The flanges 24 are removably attached to the hull 12 using fastening members 25 that are easy to remove and re-insert, such as plastic rivets. However, as noted above, the fastening members 25 are not limited to being plastic rivets and can be constituted by other fastening members as appropriate.

Figure 2B:
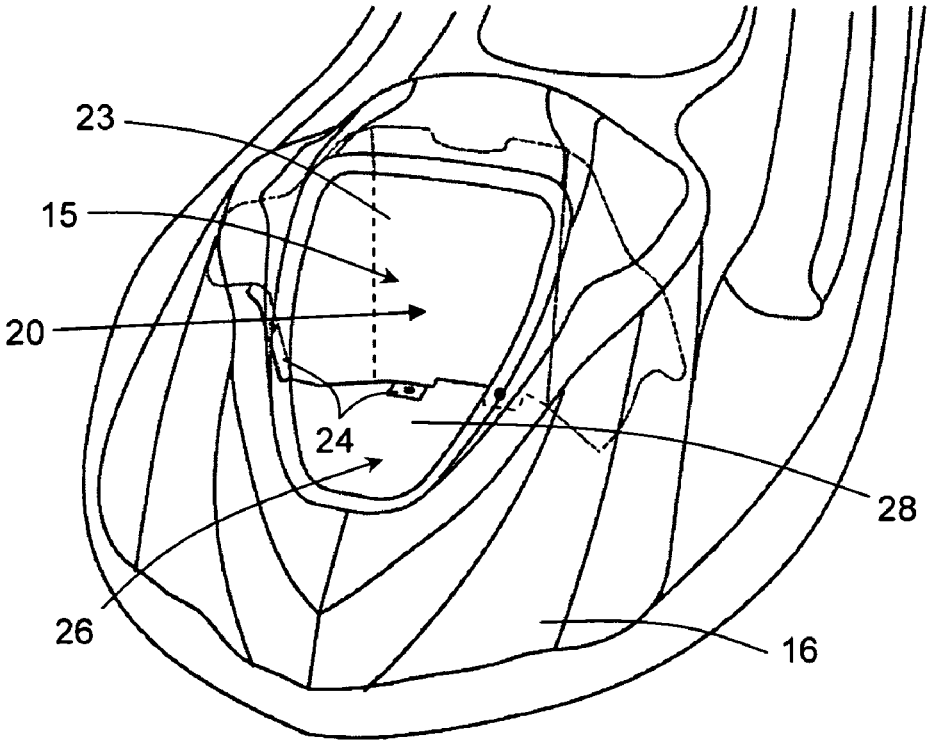
FIG. 2B is an illustration of the storage space according to a preferred embodiment of the present invention.

As shown in FIGS. 2A and 2B, the lower hull 14 includes liners 18 that extend upwards toward the deck 16. The mounting members 24 on the sides of the storage plate body 23 are attached to the liners 18, and the flanges 24 located on the bottom of the storage plate body 23 are attached to the floor 28 located at a top portion of the lower hull 14.

As shown in FIGS. 2A and 2B, the storage plate 20 is attached to the liners 18 and the floor 28 such that the storage plate body 23 is bent at an angle greater than 0° along the first bend line 21 and along the second bend line 22. Because of the material of the storage plate 20 and the flexibility provided by the bends along the first bend line 21 and along the second bend line 22, the storage plate 20 is stiff enough so that a reinforcing structure is not needed. Because a reinforcing structure is not needed, the cost of manufacturing is reduced and the ease of manufacturing and assembly/disassembly is increased. However, redundant reinforcing structures could be added to the preferred embodiment of the present invention if desired.

Figure 4:
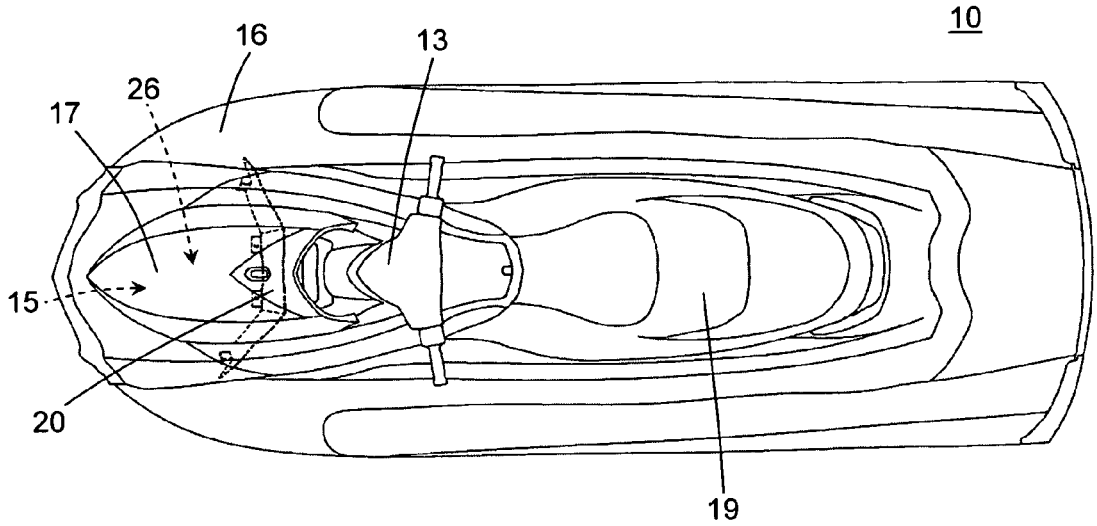
FIG. 4 is a top view illustrating the arrangement of the storage plate with respect to the interior of the hull according to a preferred embodiment of the present invention.
Figure 5:
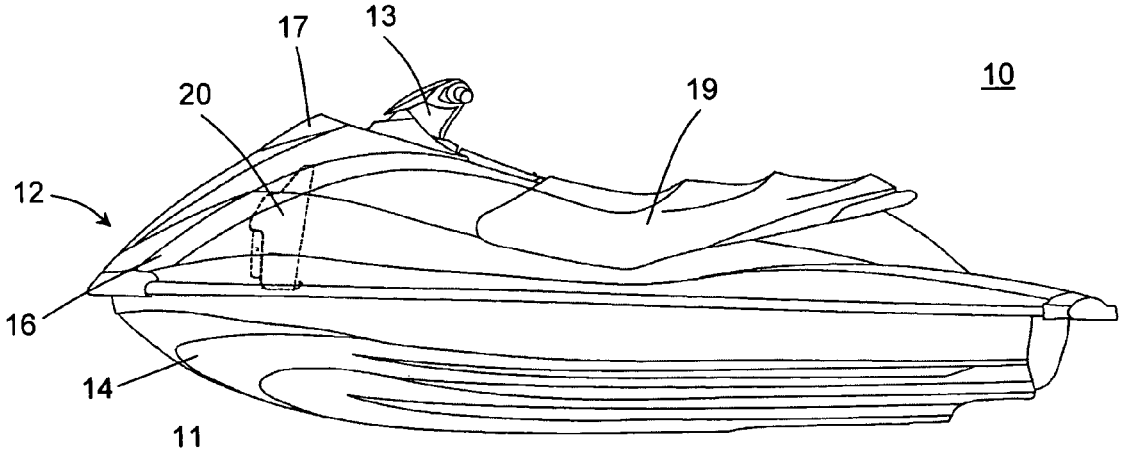
FIG. 5 is a side view illustrating the arrangement of the storage plate with respect to the interior of the hull according to a preferred embodiment of the present invention.

As stated above, the flanges 24 of the storage plate body 23 are removably attached to the hull 12 of the watercraft 10. Because the storage plate 20 can be easily removed, the area behind the storage plate 20 can be easily accessed. For example, the fuel tank (not shown) is typically located near the steering mast 13, as seen in FIGS. 4 and 5, in the interior of the hull 12 behind the storage plate 20. The fuel tank and any fuel tank sensors (not shown), including a fuel capacity detector, can easily be checked by removing the storage plate 20. If it is determined that the fuel tank sensors are faulty, then they can easily be replaced. Once the fuel tank and fuel tank sensors have been checked and possibly replaced, the mounting members 24 of the storage plate body 23 can easily be re-attached to the hull 12 of the watercraft 10 using the fastening members 25.

FIGS. 4 and 5 illustrate the storage space 26 in a completed state. The storage space 26 is defined by the storage plate 20, the liners 18 of the lower hull 14, and a portion of the deck 16. Preferably, the opening 15 in the deck 16 is covered by a hatch cover 17 as is known. That is, the opening 15 is covered by the hatch cover 17 in a watertight manner.

Figure 6:
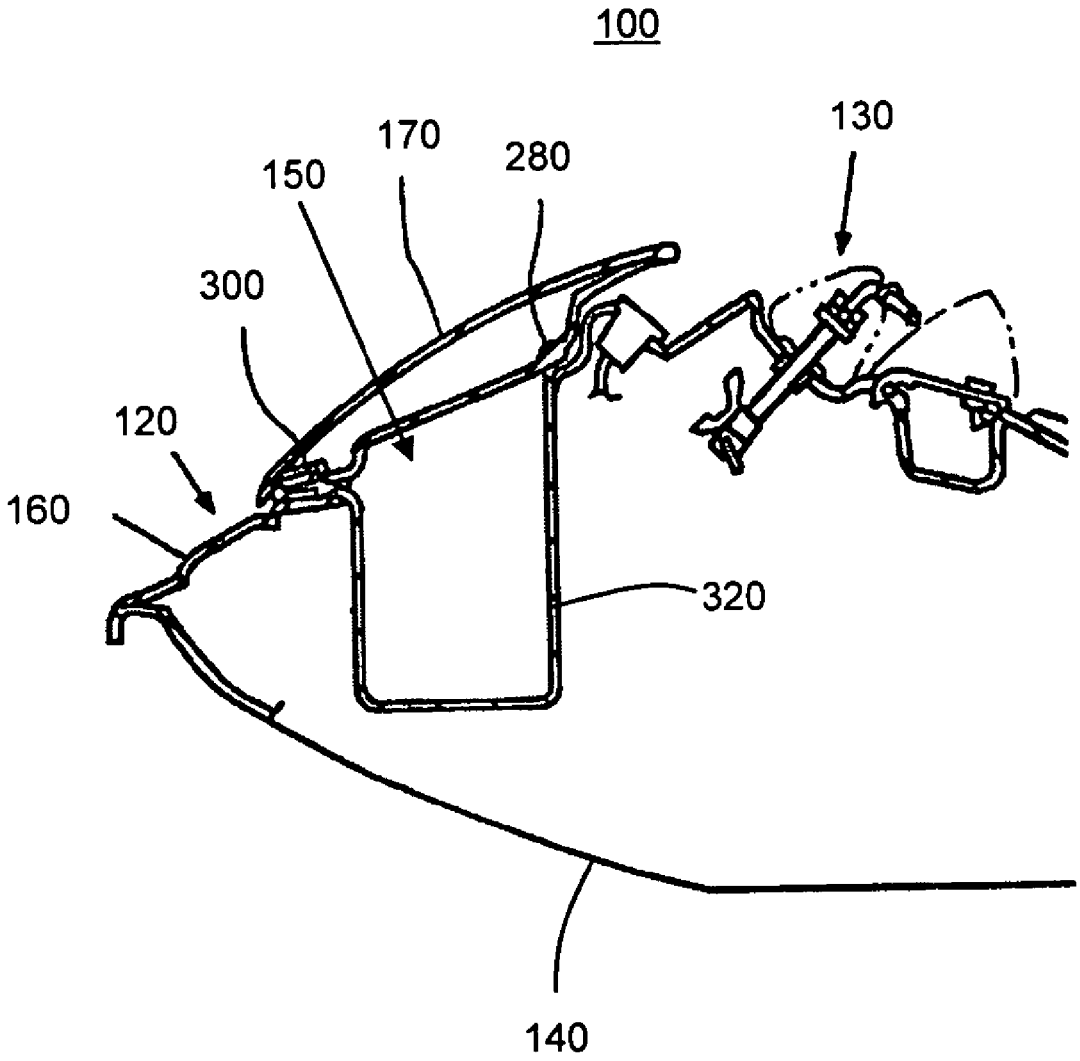
Fig. 6 Prior Art
FIG. 6 illustrates a watercraft with a prior art storage space.

As clearly seen by comparing the storage space 26 of the preferred embodiment of the present invention in FIGS. 4 and 5 with the storage box 32 of the conventional device shown in FIG. 6, the storage space 26 of the preferred embodiment of the present invention is clearly much larger and uses up all available space in the watercraft 10.

It should be understood that the foregoing description of preferred embodiments is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A watercraft comprising:

a lower hull including first and second sides;

a deck having an opening provided therein;

a storage plate including first and second ends, the first end attached to the first side of the lower hull and the second end attached to the second side of the lower hull; and a storage space defined by substantially an entire portion of the lower hull forward of the storage plate, substantially an entire portion of the deck forward of the storage plate, and the storage plate; wherein the storage plate has at least one folding line such that the storage plate can be inserted through the opening in the deck when the storage plate is folded along the at least one folding line.

2. A watercraft according to claim 1, wherein the lower hull includes at least one liner extending upwardly toward the deck, and the storage space is defined by the at least one liner, the portion of the deck and the storage plate.

3. A watercraft according to claim 1, wherein the storage plate is larger than the opening in the deck when the storage plate is in an unfolded state and is smaller than the opening in the deck when the storage plate is in a folded state.

4. A watercraft according to claim 1, wherein the storage plate is removably attached to at least one of the lower hull and the deck.

5. A watercraft according to claim 4, wherein the storage plate is attached to said at least one of the lower hull and the deck such that the storage plate has at least one fold defining at least two sections arranged at an angle relative to each other.

6. A watercraft according to claim 4, wherein the storage plate includes at least one mounting member for attaching the storage plate to said at least one of the lower hull and the deck.

7. A watercraft according to claim 6, wherein the at least one mounting member is a flange.

8. A watercraft according to claim 4, wherein the storage plate includes at least one fastening member for attaching the storage plate to said at least one of the lower hull and the deck.

9. A watercraft according to claim 8, wherein the at least one fastening member is a plastic rivet.

10. A watercraft according to claim 1, wherein the storage space is located in a bow of the watercraft.

11. A watercraft according to claim 1, wherein the lower hull includes a plurality of liners that extend upward from the lower hull toward the deck.

12. A watercraft according to claim 11, wherein the storage plate is attached to a plurality of locations along the plurality of liners.

13. A watercraft according to claim 11, wherein the storage space includes a floor disposed at a top portion of the lower hull and at a bottom portion of the storage space.

14. A watercraft according to claim 13, wherein the storage plate is attached to the floor of the storage space.

15. A watercraft according to claim 1, wherein the storage space is further defined by a hatch cover that covers the opening in the deck.

16. A method of manufacturing a watercraft comprising:

providing a watercraft having a lower hull including first and second sides and a deck, the deck having an opening therein;

inserting a storage plate into the opening of the deck, the storage plate including first and second ends, the first end being attached to the first side of the lower hull and the second end being attached to the second side of the lower hull; and forming a storage space defined by substantially an entire portion of the lower hull forward of the storage plate, substantially an entire portion of the deck forward of the storage plate, and the storage plate; wherein the storage plate has at least one bending line such that the storage plate can be inserted through the opening in the deck when the storage plate is folded along the at least one bending line.

17. A method of manufacturing a watercraft according to claim 16, wherein the step of forming a storage space includes removably attaching the storage plate to at least one of the lower hull and the deck.

18. A method of manufacturing a watercraft according to claim 16, further comprising the steps of contracting the storage plate before the step of inserting and expanding the storage plate during the step of forming the storage space.

19. A method of manufacturing a watercraft according to claim 18, wherein the step of contracting the storage plate is performed by folding the storage plate along the at least one bending line formed therein, and the step of expanding the storage plate is performed by unfolding the storage plate along the at least one bending line.

20. A method of manufacturing a watercraft according to claim 16, wherein the lower hull includes liners that extend upward from the lower hull toward the deck, and the storage space is defined by the liners, said portion of the deck, and the storage plate.

* * * * *